US011147344B2

(12) United States Patent
Bernhard et al.

(10) Patent No.: US 11,147,344 B2
(45) Date of Patent: Oct. 19, 2021

(54) RUNNING SHOE HAVING LACING

(71) Applicant: ON CLOUDS GMBH, Heiden (CH)

(72) Inventors: Olivier Bernhard, Heiden (CH); Ilmarin Heitz, Zürich (CH)

(73) Assignee: ON CLOUDS GMBH, Zürich (CH)

( * ) Notice: Subject to any disclaimer, the term of this patent is extended or adjusted under 35 U.S.C. 154(b) by 0 days.

(21) Appl. No.: 15/575,728

(22) PCT Filed: May 18, 2016

(86) PCT No.: PCT/EP2016/061118
§ 371 (c)(1),
(2) Date: Nov. 20, 2017

(87) PCT Pub. No.: WO2016/184899
PCT Pub. Date: Nov. 24, 2016

(65) Prior Publication Data

US 2018/0295941 A1 Oct. 18, 2018

(30) Foreign Application Priority Data

May 20, 2015 (CH) ..... 00701/15

(51) Int. Cl.
*A43C 1/00* (2006.01)
*A43B 23/02* (2006.01)
(Continued)

(52) U.S. Cl.
CPC ..... *A43C 1/003* (2013.01); *A43B 23/025* (2013.01); *A43B 23/0275* (2013.01);
(Continued)

(58) Field of Classification Search
CPC ..... A43C 1/00–5/00
See application file for complete search history.

(56) References Cited

U.S. PATENT DOCUMENTS 4,123,856 A * 11/1978 Lawson ..... A43B 5/02 36/114
4,255,876 A * 3/1981 Johnson ..... A43B 5/00 36/129

(Continued)

FOREIGN PATENT DOCUMENTS

WO WO 2011/091325 A1 7/2011

OTHER PUBLICATIONS http://www/fieggen.com/shoelace/doub1ebacklacing.htm, Ian's Shoelace Site, "Double Back Lacing," Retrieved Jul. 12, 2016, XP055287805 (2 pages).

(Continued)

*Primary Examiner* — Jila M Mohandesi
(74) *Attorney, Agent, or Firm* — Pauley Erickson & Swanson

(57) ABSTRACT

A running shoe includes medial and lateral eyelets arranged on the medial and lateral side in the longitudinal direction from the front foot area of the running shoe to the heel section, wherein in each case a medial eyelet and a lateral eyelet located at the same height in the longitudinal direction form an eyelet pair; reinforcing ribs are arranged on the medial and lateral side in the front foot area, wherein the reinforcing ribs are arranged at an acute rib angle to the longitudinal direction of the running shoe, and a lace having lace sections for lacing, wherein the lace is led through the eyelets in such a way that the lace sections extending from the eyelets of the first lace pair in relation to the front foot area, each run at an acute lacing angle to the longitudinal direction to at least one further eyelet closer to the heel section.

20 Claims, 2 Drawing Sheets

(51) Int. Cl.
*A43B 23/26* (2006.01)
*A43C 5/00* (2006.01)

(52) U.S. Cl.
CPC ..... *A43B 23/0295* (2013.01); *A43B 23/26* (2013.01); *A43C 1/00* (2013.01); *A43C 5/00* (2013.01)

(56) References Cited

U.S. PATENT DOCUMENTS 5,184,378 A * 2/1993 Batra ..... A43C 1/04 24/714.6
5,377,430 A * 1/1995 Hatfield ..... A43B 3/08 24/714.6
5,566,474 A * 10/1996 Leick ..... A43C 1/00 36/50.1
D392,792 S * 3/1998 Obi ..... A43C 1/04 D2/969
5,862,614 A * 1/1999 Koh ..... A43B 13/223 36/31
6,412,195 B1 * 7/2002 Mack ..... A43B 23/082 36/114
6,467,194 B1 * 10/2002 Johnson ..... A43C 1/06 36/118.1
6,941,683 B2 * 9/2005 Freed ..... A43C 1/003 24/712
8,713,820 B2 * 5/2014 Kerns ..... A43C 11/004 36/50.1
8,806,776 B2 * 8/2014 Leick ..... A43B 1/0081 12/142 LC
9,526,300 B2 * 12/2016 Krengel ..... A41F 1/04
9,730,492 B2 * 8/2017 Krengel ..... A43C 7/00
2004/0078999 A1 * 4/2004 Freed ..... A43C 1/003 36/50.1
2011/0113648 A1 5/2011 Leick et al.
2012/0124866 A1 * 5/2012 Moriyasu ..... A43B 7/1495 36/83
2013/0086815 A1 * 4/2013 Toraya ..... A43C 7/005 36/83

OTHER PUBLICATIONS

European Patent Office, International Search Report, Form PCT/ISA/210, for International Application No. PCT/EP2016/061118, dated Jul. 22, 2016, (3 pages).

* cited by examiner

RUNNING SHOE HAVING LACING

BACKGROUND OF THE INVENTION

Field of the Invention

The present invention relates to a running shoe having lacing.

Discussion of Related Art

Important properties of running shoes include a good hold on the foot and a high level of wearing comfort, among other things. To this end, running shoes are typically provided with a lacing in order to ensure a stable hold on the foot in the running shoe. In this connection, the lacing is accomplished by means of a lace with lace segments that are threaded through eyelets provided on the running shoe. The eyelets are frequently arranged in two rows so that the lace segments of the lacing rest on the instep of the foot.

For example, known lacings include cross lacing in which the lace segments are threaded back and forth in crisscross fashion through eyelets on opposing sides. With parallel lacing, the lace segments are threaded through the eyelets so that lace segments extending across the instep extend parallel to the transverse direction of the running shoe.

In running shoes, the directions are generally defined as follows: The longitudinal direction of the running shoe is defined by an axis extending from the forefoot region to the heel section of the running shoe. The transverse direction is defined by an axis perpendicular to the longitudinal direction. A transverse direction extending transversely across the instep should be understood to mean that in the top view of the running shoe, it corresponds to the axis that is perpendicular to the longitudinal direction, but in a front view of the running shoe, can be curved, following the profile of the instep.

The counting of the eyelets or eyelet pairs is understood to start counting in the forefoot region of the running shoe so that the "first" eyelets are the two eyelets of the "first" eyelet pair that are positioned the closest to the toe of the running shoe. The indication "at the same latitude in the longitudinal direction" in relation to the above-mentioned counting is understood to mean that for example the two third eyelets are positioned at the same latitude in the longitudinal direction and constitute the third eyelet pair. The indication "opposite" should be understood to mean that an eyelet opposite from a medial/lateral eyelet is a lateral/medial eyelet and the two opposing eyelets do not have to be positioned at the same latitude. The expression "lateral/medial eyelet" should be understood to mean that they eyelet is positioned on the lateral/medial side of the running shoe.

In some lacings, some eyelets are skipped, i.e. the lace is not threaded through these eyelets. In such a case, the counting of the eyelets is based on the eyelets through which the lace is threaded.

There are various other known lacings that are neither a crossed lacing nor a parallel lacing. One example is pentagram lacing in which the lace is threaded through the eyelets so that the lace segments of the lace form a pentagram, with the two bottom points of the pentagram being formed by lace segments that pass through the first two eyelets in relation to the forefoot region. The two side points of the pentagram are formed by lace segments that pass through subsequent eyelets, e.g. the third or fourth eyelets. The top point of the pentagram is formed in that the lace segment that forms the top point passes over another lace segment, which connects two eyelets to each other in the transverse direction. The lace segment that connects two eyelets to each other in the transverse direction therefore serves as a kind of support for the lace segment, which forms the top point. The pentagram lacing is primarily used for esthetic purposes and because of the above-mentioned type of lacing, does not offer the possibility of exerting as much tensile force for a secure closure as cross lacing, for example. Also, pentagram lacing is not a symmetrical lacing, since corresponding lace segments of the pentagram are not formed by lace segments of the respective halves of the lace.

SUMMARY OF THE INVENTION

Because of the potential uses in everyday life and particularly in sports, a good hold in the running shoe and a high wearing comfort are particularly important.

The object of the invention, therefore, is to provide a running shoe that improves the prior art of running shoes, particularly with regard to the hold and the wearing comfort.

According to the invention, this object is attained by means of a running shoe as described. Exemplary and/or advantageous embodiments are indicated in the claims and in the present disclosure.

The running shoe according to the invention includes medial and lateral eyelets arranged in the longitudinal direction, extending from the forefoot region of the running shoe to the heel section on the medial and lateral sides, with a medial eyelet and a lateral eyelet respectively positioned at the same latitude in the longitudinal direction as this medial eyelet constituting an eyelet pair. The running shoe has reinforcing ribs in the forefoot region on the medial and lateral sides, with the reinforcing ribs being oriented at an oblique rib angle relative to the longitudinal direction of the running shoe. In addition, the running shoe includes at least one lace with lace segments for a lacing in which the lace is threaded through the eyelets so that the lace segments extending from the eyelets of the first eyelet pair in relation to the forefoot region each extend at an oblique lacing angle relative to the longitudinal direction to at least one other eyelet closer to the heel section.

An "oblique angle" is understood to be an angle that is not equal to 0°, 90° or 180°.

The arrangement of the reinforcing ribs according to the invention at an oblique rib angle relative to the longitudinal direction of the running shoe and the lace segments extending from the eyelets of the first eyelet pair in relation to the forefoot region, at an oblique lacing angle relative to the longitudinal direction offers the advantage, among other things, that the tensile forces when tightening the lacing do not act mainly in the transverse direction, but instead act essentially more effectively in an oblique direction; the tensile forces are introduced into the reinforcing ribs at least without a significant deflection. Preferably, the rib angle and the lacing angles have values that differ at most only slightly from each other. The exertion of the tensile force of the lacing in an oblique direction also has an advantageous effect on the wearing comfort since the laces exert less of a clamping action on the forefoot region. It is thus possible to more firmly tighten the lacing without negatively affecting the wearing comfort, which in turn has a positive effect on the hold in the running shoe.

The lacing angles can, for example, be between 25° and 65°, preferably between 35° and 55°, and more preferably between 40° and 50°. The lacing angles are defined by the acute angle between the longitudinal direction of the running shoe and the lace segments.

The rib angle can, for example, be 25° and 65°, preferably between 35° and 55°, and more preferably between 40° and 50°. The rib angle is defined by the acute angle between the longitudinal direction of the running shoe and the direction of the reinforcing rib.

Preferably, the medial and lateral eyelets are respectively arranged along a line on the medial and lateral sides of the shaft of the running shoe. The running shoe can be equipped so that a part of the medial and/or lateral side(s) of the shaft rests on the instep so that the eyelets can likewise rest on the instep.

Preferably, a medial eyelet and a lateral eyelet of an eyelet pair following the first eyelet pair in relation to the forefoot region are directly connected by a lace segment. In the direct connection, the lace segment that connects the medial eyelet and the lateral eyelet generally extends across the instep in the transverse direction of the running shoe. But if the eyelets of an eyelet pair do not both lie along the transverse direction, then the direct connection can also extend obliquely in relation to the longitudinal direction. The direct connection of the eyelets of an eyelet pair that follows the first eyelet pair makes it possible to avoid a direct connection of the eyelets of the first eyelet pair. Such a lacing thus differs, for example, from a cross lacing known from the prior art in which the eyelets of the first eyelet pair are directly connected and when the lacing is tightened, the tensile force thus mainly acts in the transverse direction of the running shoe.

In a preferred embodiment, the medial and lateral eyelets that are directly connected by a lace segment are the eyelets of the second eyelet pair relative to the forefoot region. Such a lacing can be achieved, for example, by threading each end of a lace first respectively through the medial and lateral eyelet of the second eyelet pair and then threading the respective lace segment from the medial/lateral eyelet of the second eyelet pair to the opposite lateral/medial eyelet of the first eyelet pair, and pulling the respective lace segments from the eyelets of the first eyelet pair to the opposite eyelets of the third eyelet pair. It is thus possible to produce a star-shaped lacing in which the eyelets of the first eyelet pair are not directly connected to each other.

It is thus possible, starting from the eyelets of the first eyelet pair, for a first lace segment to extend to the opposite eyelet of the second eyelet pair and for a second lace segment to extend to the opposite eyelet of the third eyelet pair.

For the eyelets of the second eyelet pair or of the subsequent eyelet pairs, a direct connection and a resulting tensile force in the transverse direction of the running shoe can be advantageous and desirable since in this region of the running shoe, the parts of the medial and lateral side of the running shoe should be pulled together in the transverse direction as efficiently as possible.

In one embodiment, the eyelets, which follow the eyelets of an eyelet pair directly connected by a lace segment and which are closer to the heel section, are connected by means of a cross lacing.

In one embodiment, the eyelets, which follow the eyelets of an eyelet pair directly connected by a lace segment and which are closer to the heel section, are connected by means of a parallel lacing.

Depending on the application field, the running shoe according to the invention can thus include conventional lacing from the prior art for the eyelets that follow the eyelets directly connected by a lace segment.

Preferably, the running shoe has a single lace for the lacing. The lacing can, however, also include a plurality of laces.

According to a preferred embodiment, the eyelets of the first eyelet pair are respectively positioned on the medial and lateral reinforcing rib. This has the advantage that the tensile forces of the lace segments that extend from the eyelets of the first eyelet pair can act on the reinforcing ribs. With a suitable rib angle and suitable lacing angles, when the lacing is tightened, this can enable an efficient transmission of force and an optimum pressure distribution in the forefoot region, with a majority of the force being introduced into the reinforcing ribs and in the direction of these reinforcing ribs.

In one embodiment, the distance in the longitudinal direction between the eyelets of the first eyelet pair and the eyelets of the second eyelet pair is greater than the respective distance in the longitudinal direction between the eyelets of the subsequent eyelet pairs.

In one embodiment, the lace segments that extend from the eyelets of the first eyelet pair enclose an acute opening angle.

In one embodiment, the eyelets of the first eyelet pair are loops that are sewn into the reinforcing ribs. This has the advantage that the tensile forces that are transmitted via the eyelets of the first eyelet pair are more efficiently transmitted to the reinforcing ribs.

BRIEF DESCRIPTION OF SEVERAL VIEWS OF THE DRAWINGS

Embodiments of the invention will be explained in greater detail based on the following figures and the associated descriptions. In the drawings.

DETAILED DESCRIPTION OF THE INVENTION

In order to explain the invention, a preferred embodiment will be described in greater detail with reference to the figures.

Figure 1:
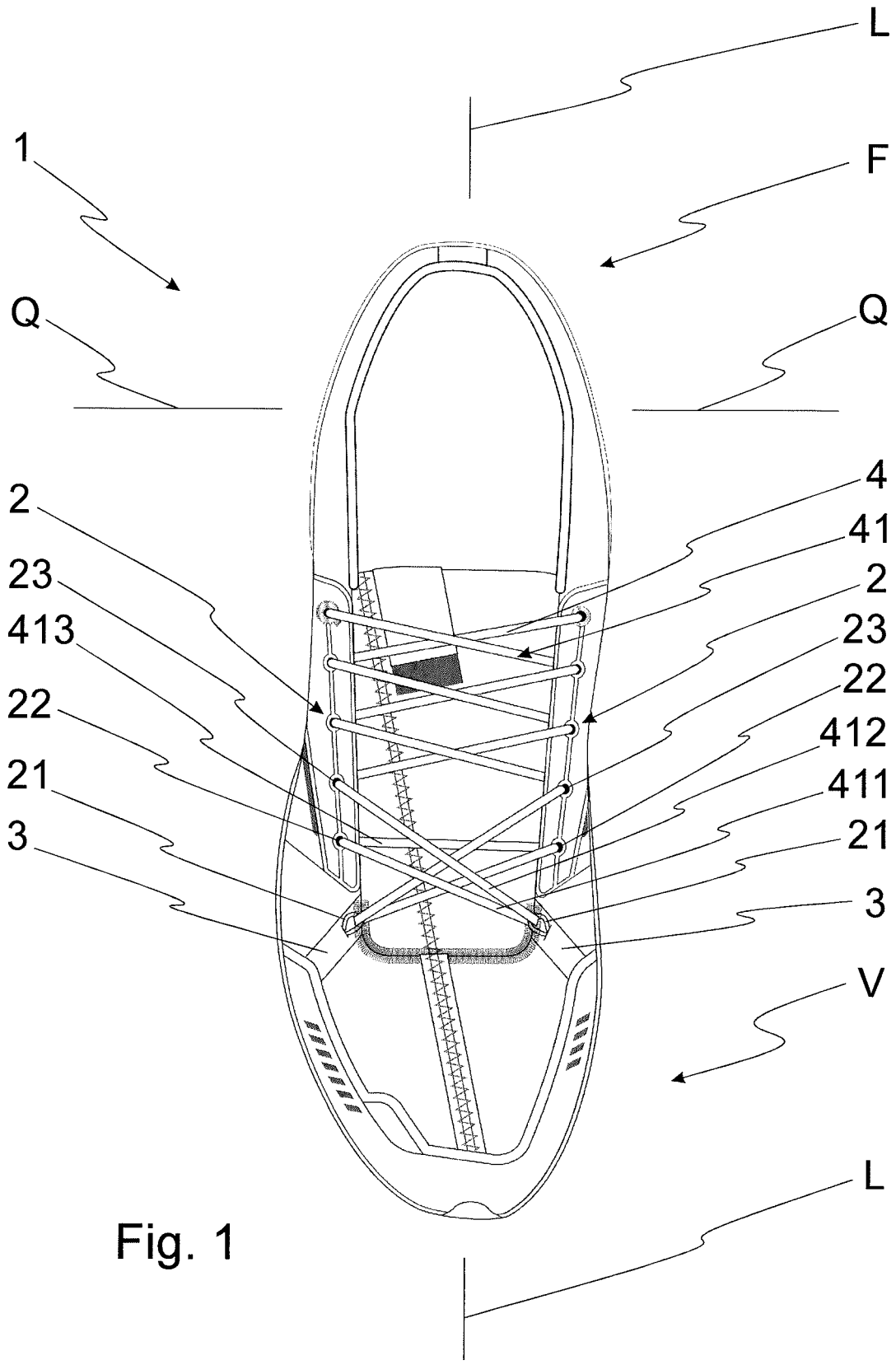
FIG. 1 is a top view of an embodiment of a running shoe.

FIG. 1 is a top view of an embodiment of a right running shoe 1 with a lacing. The running shoe 1 has medial and lateral eyelets 2 positioned on the medial and lateral sides of the running shoe 1. The eyelets 2 are arranged in two rows extending along the longitudinal direction L from the forefoot region V to the heel section F. The lacing is produced by means of a lace 4 with lace segments 41 that are threaded through the eyelets 2. In the forefoot region V, reinforcing ribs 3 are provided on the medial and lateral sides of the running shoe 1, extending at an oblique rib angle relative to the longitudinal direction L. The eyelets 21 of the first eyelet pair relative to the forefoot region V are sewn into the reinforcing ribs 3. The eyelets 21 are embodied in the form of loops. From the eyelets 21 of the first eyelet pair, two respective lace segments 411 and 412 extend to the subsequent eyelets 22 and 23. The lace segment 411 extends at a first oblique lacing angle relative to the longitudinal direction L, from the medial/lateral eyelet 21 of the first eyelet pair to the lateral/medial eyelet 22 of the second eyelet pair. The lace segment 412 extends at a second oblique lacing angle relative to the longitudinal direction L, from the medial/lateral eyelet 21 of the first eyelet pair to the lateral/medial eyelet 23 of the third eyelet pair. If the lacing is tightened, then the tensile forces exerted by means of the lacing 4 act chiefly in the directions of the reinforcing ribs 3. The eyelets 22 of the second eyelet pair are directly connected by a lace segment 413. The lace segment 413 extends along the transverse direction Q. The eyelets that follow the directly connected eyelets 22 are connected by means of a cross lacing. Instead of the cross lacing, however, a parallel lacing can also be used.

Figure 2:
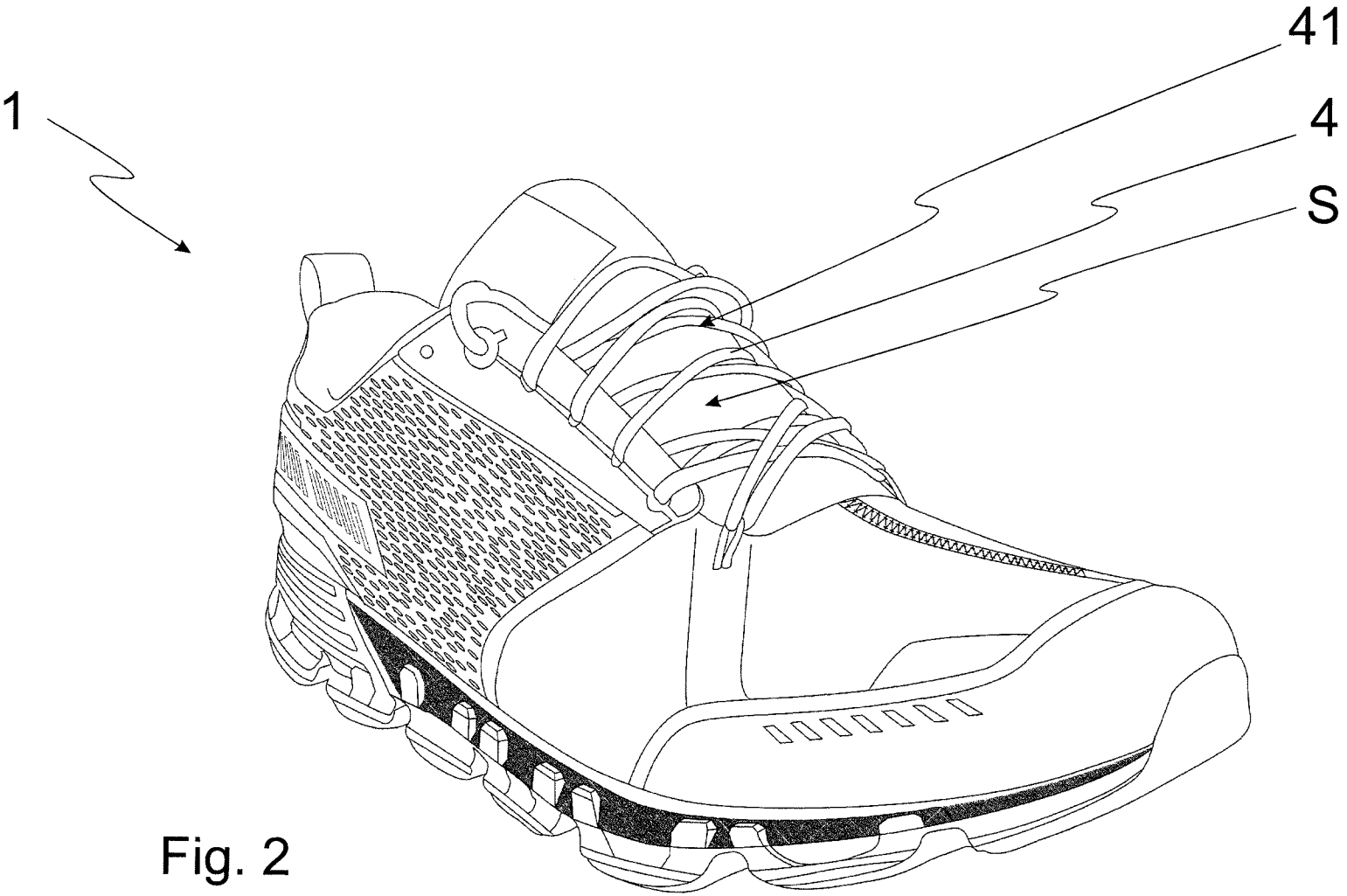
FIG. 2 is a perspective view of the running shoe from FIG. 1.

FIG. 2 is a perspective view of the running shoe 1 from FIG. 1. The drawing clearly shows that the lace segments 41 of the lacing 4 extend across the instep S.

The invention claimed is:

1. A running shoe comprising:

medial and lateral eyelets extending in the longitudinal direction from a forefoot region of the running shoe to a heel section on medial and lateral sides, with a medial eyelet and a lateral eyelet respectively positioned at a same latitude in the longitudinal direction as the medial eyelet constituting an eyelet pair, and a first eyelet pair being a closest eyelet pair in relation to the forefoot region;

a reinforcing rib extending from each of the eyelets of the first eyelet pair, the reinforcing rib extending only in a direction toward the forefoot region at an oblique rib angle relative to the longitudinal direction of the running shoe; and a single lace threaded through the eyelets, wherein two lace segments extend from the each of the eyelets of the first eyelet pair, each of the two lace segments extending to an other of the eyelets closer to the heel section, and positioned at a corresponding one of two oblique lacing angles relative to the longitudinal direction, the oblique lacing angles facing the forefoot region;

wherein at the each of the eyelets of the first eyelet pair, the oblique rib angle and the two oblique lacing angles are obliquely configured to collectively conform tensile forces upon tightening the lace in an oblique direction to the longitudinal direction, toward the forefoot region.

2. The running shoe according to claim 1, wherein the oblique lacing angles are between 25° and 65°.

3. The running shoe according to claim 1, wherein the oblique rib angle is between 25° and 65°.

4. The running shoe according to claim 1, wherein the eyelets of the first eyelet pair are respectively positioned on the medial and lateral reinforcing rib.

5. The running shoe according to claim 1, wherein a distance in the longitudinal direction between the eyelets of the first eyelet pair and the eyelets of the second eyelet pair is greater than a respective distance in the longitudinal direction between the eyelets of the subsequent eyelet pairs.

6. The running shoe according to claim 1, wherein the two lace segments that extend from the each of the eyelets of the first eyelet pair enclose an acute opening angle.

7. The running shoe according to claim 1, wherein the eyelets of the first eyelet pair are loops that are sewn into the reinforcing ribs.

8. The running shoe according to claim 1, wherein the oblique lacing angles are between 35° and 55° and the oblique rib angle is between 35° and 55°.

9. The running shoe according to claim 1, wherein the oblique lacing angles are between 40° and 50° and the oblique rib angle is between 40° and 50°.

10. The running shoe according to claim 1, wherein a transverse segment of the single lace extends across an instep of the running shoe to directly connect a second eyelet pair following the first eyelet pair.

11. The running shoe according to claim 10, wherein each of the two lace segments of the eyelets of the first eyelet pair cross the transverse segment in extending to the other of the eyelets closer to the heel section.

12. A running shoe comprising:

medial and lateral eyelets extending in the longitudinal direction from a forefoot region of the running shoe to a heel section on medial and lateral sides, with a medial eyelet and a lateral eyelet respectively positioned at a same latitude in the longitudinal direction as the medial eyelet constituting an eyelet pair, and a first eyelet pair being a closest eyelet pair in relation to the forefoot region;

a reinforcing rib extending from each of the eyelets of the first eyelet pair, the reinforcing rib extending only in a direction toward the forefoot region at an oblique rib angle relative to the longitudinal direction of the running shoe; and a lace threaded through the eyelets, wherein two lace segments extend from the each of the eyelets of the first eyelet pair, each of the two lace segments extending to an other of the eyelets closer to the heel section, and positioned at a corresponding one of two oblique lacing angles relative to the longitudinal direction, the oblique lacing angles facing the forefoot region;

wherein at the each of the eyelets of the first eyelet pair, the oblique rib angle and the two oblique lacing angles are obliquely configured to collectively conform tensile forces upon tightening the lace in an oblique direction to the longitudinal direction, toward the forefoot region; and wherein a medial eyelet and a lateral eyelet of a second eyelet pair following the first eyelet pair relative to the forefoot region are directly connected across an instep of the running shoe by a transverse lace segment extending across the instep of the running shoe.

13. The running shoe according to claim 12, wherein the medial and lateral eyelets of the second eyelet pair that are directly connected by the transverse lace segment are closer to the heel section and adjacent to the first eyelet pair.

14. The running shoe according to claim 13, wherein starting from the eyelets of the first eyelet pair, a first lace segment of the two lace segments extends to a first opposite eyelet of the second eyelet pair and a second lace segment of the two lace segments extends to a second opposite eyelet of a third eyelet pair adjacent the second eyelet pair.

15. The running shoe according to claim 12, wherein the eyelets, which follow the eyelets of an eyelet pair directly connected by a lace segment and which are closer to the heel section, are connected by means of a parallel lacing.

16. The running shoe according to claim 12, wherein a single lace is threaded through the eyelets.

17. A running shoe comprising:

medial and lateral eyelets extending in the longitudinal direction from a forefoot region of the running shoe to a heel section on medial and lateral sides, with a medial eyelet and a lateral eyelet respectively positioned at a same latitude in the longitudinal direction as the medial eyelet constituting an eyelet pair, and a first eyelet pair being a closest eyelet pair in relation to the forefoot region;

reinforcing ribs provided in the forefoot region on the medial and lateral sides, the reinforcing ribs being oriented at an oblique rib angle relative to the longitudinal direction of the running shoe; and at least one lace for a lacing, the at least one lace being threaded through the eyelets with two lace segments extending from each of the eyelets of the first eyelet, at an oblique lacing angle relative to the longitudinal direction, to at least two other eyelets closer to the heel section;

wherein a medial eyelet and a lateral eyelet of a second eyelet pair following the first eyelet pair are directly connected across an instep of the running shoe by a transverse lace segment extending across the instep of the running shoe between the medial eyelet and the lateral eyelet of the second eyelet pair.

18. The running shoe according to claim 17, wherein one of the two lace segments extending from each of the eyelets of the first eyelet directly connects to the transverse lace segment.

19. A running shoe comprising:

medial and lateral eyelets extending in the longitudinal direction from a forefoot region of the running shoe to a heel section on medial and lateral sides, with a medial eyelet and a lateral eyelet respectively positioned at a same latitude in the longitudinal direction as the medial eyelet constituting an eyelet pair, and a first eyelet pair being a closest eyelet pair in relation to the forefoot region;

reinforcing ribs provided in the forefoot region on the medial and lateral sides, the reinforcing ribs being oriented at an oblique rib angle relative to the longitudinal direction of the running shoe; and a single lace threaded through the eyelets, the single lace including two medial lace segments extending from a first medial eyelet of the first eyelet pair, and the single lace including two lateral lace segments extending from a first lateral eyelet of the first eyelet pair, each of the two medial lace segments and each of the two lateral eyelets extending to a corresponding other of the eyelets closer to the heel section, and positioned at a corresponding one of two oblique lacing angles relative to the longitudinal direction, the oblique lacing angles facing the forefoot region.

20. The running shoe according to claim 19, wherein a transverse segment of the single lace extends across an instep of the running shoe to directly connect across the instep a second eyelet pair following the first eyelet pair.

* * * * *